US006102128A

United States Patent [19]

Bridgeman

[11] Patent Number: 6,102,128

[45] Date of Patent: Aug. 15, 2000

[54] FIRE-RESISTANT BLANKET

[76] Inventor: William M. Bridgeman, 1101 Iroquois, SE., Grand Rapids, Mich. 49506

[21] Appl. No.: 09/041,341

[22] Filed: Mar. 12, 1998

Related U.S. Application Data

[60] Provisional application No. 60/040,511, Mar. 13, 1997.

[51] Int. Cl.[7] ..... A62C 2/06

[52] U.S. Cl. ..... 169/49; 169/54

[58] Field of Search ..... 169/45, 48, 49, 169/54

[56] References Cited

U.S. PATENT DOCUMENTS

| | | | |
|---|---|---|---|
| 3,806,959 | 4/1974 | Gross . | |
| 5,083,617 | 1/1992 | Pierce, Jr. | 169/50 |
| 5,490,567 | 2/1996 | Speer | 169/50 |
| 5,560,990 | 10/1996 | Llg et al. | 428/362 |
| 5,582,912 | 12/1996 | McCullough, Jr. et al. . | |
| 5,628,066 | 5/1997 | Gottlieb et al. | 169/48 X |

*Primary Examiner*—Lesley D. Morris
*Attorney, Agent, or Firm*—Price, Heneveld, Cooper, DeWitt & Litton

[57] ABSTRACT

A heat insulating blanket for use in fire emergencies comprises a lightweight, pliant section of fabric comprised of organic fibers and is compatible with human skin contact. The fabric has fire-resistant properties to insulate a user from high heat or flame sources associated with fire emergencies and prevents burn injuries to the user until the user escapes from the fire emergency area.

17 Claims, 2 Drawing Sheets

FIRE-RESISTANT BLANKET

CROSS-REFERENCE TO RELATED APPLICATION

This application claims the benefit of U.S. provisional application Ser. No. 60/040,511, filed Mar. 13, 1997.

BACKGROUND OF THE INVENTION

The present invention relates to fire safety products and methods. Heat and flame resistant fibers are used to produce fire-resistant clothing for fire fighters. Fire fighting clothing, such as fire turnout gear utilized by fire departments, generally comprise overgarments which are manufactured and specifically designed to protect a fire fighter while attacking a fire. As such, the use of such garments is subject to and dependent upon the formal training of the user and the strict guidelines under which fire fighters operate while fighting a fire. These fire fighting apparel products have a high performance relative to fire resistance and come at a correspondingly high cost. The materials range from fibers from the aramid family, such as fibers marketed under the NOMEX® and KEVLAR® trademarks to even higher-technology, higher-cost fibers such as polyamide fibers marketed under the trademark P84® and the like. The fireproof fabrics used in the outer layer of fire fighting turnout gear typically are not soft, pliable, or friendly to human skin.

Glass fibers are used to fabricate fire extinguishing blankets for use in smothering fires associated with restaurant grease fires, home grease fires, or other like localized and highly flammable situations. These blankets typically include one or more of water-soaked fabric layers, polyester sheets impregnated with hydrous gels, metallic layers, or layers of inorganic fibers. These blankets have been developed and optimized for use as a fire extinguishing tool.

SUMMARY OF THE INVENTION

The present invention comprises a soft, user friendly, fire-resistant blanket which does not act as a skin irritant. The blanket can be used as a normal blanket in children's rooms, for example, and can also be used in the event of a fire in which an individual may be wrapped up in the blanket and either move through flames to safety or wait until rescue personnel arrive. An elongated "runner" can also be kept handy for purposes of spreading over a flaming area of flooring to facilitate moving quickly over that area to an area of safety, or alternatively, to drape over a hot or burning windowsill for the purpose of exiting the burning structure to safety.

One aspect of the present invention is a heat insulating blanket for use in fire emergencies. The heat insulating blanket comprises a lightweight, pliant section of fabric which is comprised of organic fibers and is compatible with human skin contact. The fabric has fire-resistant properties wherein the blanket insulates a user from high heat or flame sources associated with fire emergencies and prevents burn injuries to the user until the user escapes from the fire emergency area.

Another aspect of the present invention is a method for providing for fire safety including the steps of providing a user with a lightweight, pliant blanket made of fire-resistant fibers which can serve to provide warmth during normal usage, and then wrapping the user in the blanket in the event of fire to provide protection from the fire and facilitate the user's escape from the fire.

Yet another aspect of the present invention is a method for providing for fire safety comprising the steps of providing a user with a lightweight, pliant blanket made of fire-resistant fibers which can serve to provide warmth during normal usage, spreading the blanket across a hot or burning surface, and removing the user from the fire or hot area by traversing the spread out blanket.

These and other objects, advantages, and features of the invention can be more fully understood and appreciated by reference to the written specification and appended drawings.

DETAILED DESCRIPTION OF THE PREFERRED EMBODIMENTS

Figure 1:
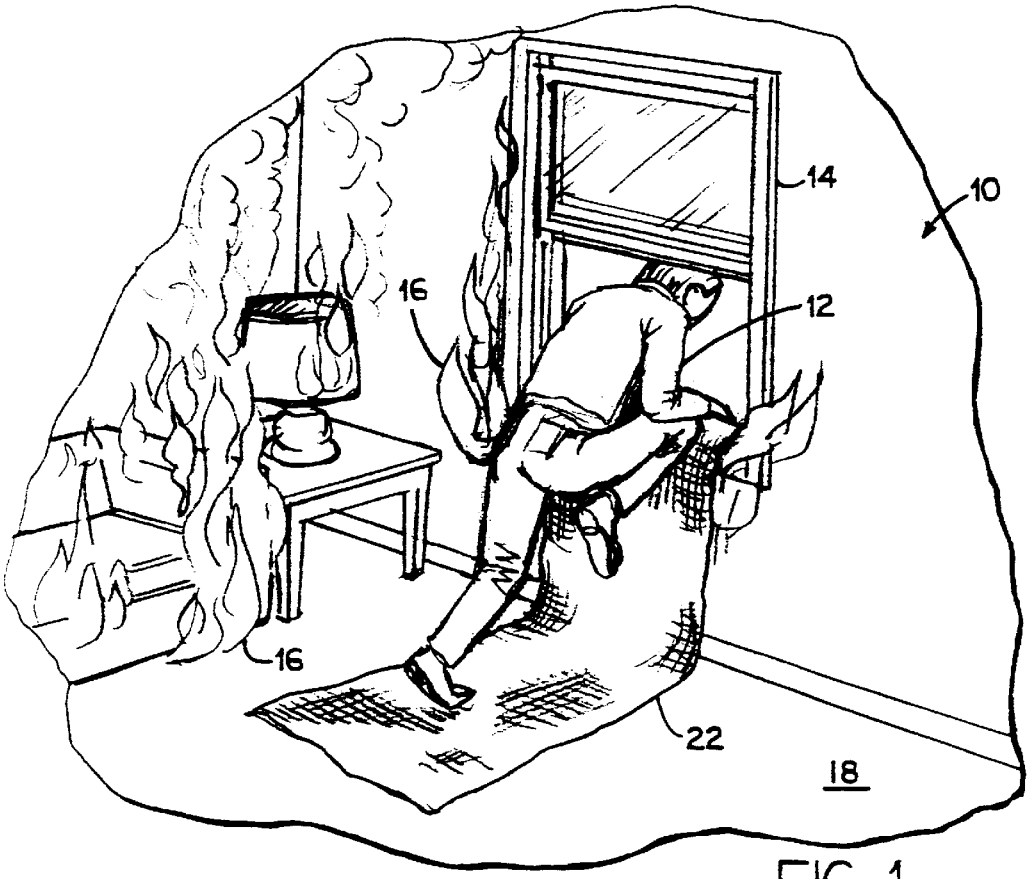
FIG. 1 is a perspective view of a burning room showing a blanket according to the present invention in use on the floor and on a windowsill to shield a person from flames and high temperatures.

For purposes of description herein, the terms "upper," "lower," "right," "left," "front," "rear, " "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

According to the preferred embodiment, a soft, fire-resistant blanket is comprised of one or more types of organic fire-resistant fibers. While there are numerous inorganic fibers which are also fire-resistant or fireproof, such fibers possess a general characteristic of being an irritant to human skin, therefore rendering the use of such fibers in a fabric or blanket which is intended for human contact, to be undesirable. Typically, the organic fire-resistant fibers suitable for use in the preferred embodiment are members of the polyamide, melamine, or acrylic families.

In selecting the appropriate fibers for use in a fire-resistant blanket according to the present invention, additional characteristics are preferably taken into consideration beyond the fiber's performance as a fire-resistant fiber. Since one of the primary uses of a blanket according to the present invention is for emergency use in a residential application, the blanket should be economical to produce so as to be affordable for private individuals and, at the same time, be sufficiently lightweight and pliant to facilitate use by young children.

While many of the fibers possess the requisite fire-resistant characteristic desired of a fiber for use in such a blanket, these fibers may also have inherent characteristics which lessen their desirability for such use. For example, some of the organic fibers which are fire-resistant also display characteristics of being of extremely high strength, and thus are difficult to cut and cause excessive wear on the looms used to weave the fire-resistant fabric. Other fibers, while displaying fire-resistant characteristics, may tend to either shrink or melt at elevated temperatures, both of which characteristics decrease the desirability of the fiber for use in the subject blanket. Other fire-resistant fibers may expel toxic gasses at elevated temperatures which would jeopardize the life and health of an individual who is attempting to use the blanket in a fire emergency. Also, candidate fibers of the fire-resistant category are often times relatively expensive when compared to other fibers. Thus, the selection of one or more fibers becomes dependent upon a number of characteristics in order to produce a fabric which is economical, lightweight, and safe for human use in an emergency situation to protect and shield an individual in a fire emergency.

Melamine and melamine/formaldehyde based resinous fibers display desirable heat stability, solvent resistance, low flammability, and high-wear performance characteristics. These fibers are adaptable for processing on standard textile manufacturing equipment for the formation of a variety of fabrics, such as woven, knit, and non-woven products. The fibers may be used at a continuous temperature of 200° C. and exhibit a maximum use temperature range of 260° C.–370° C. while exhibiting minimal shrinkage at these elevated temperatures. One form of the melamine/formaldehyde fiber is marketed under the name BASOFIL®.

The polyamide family of fibers is probably the most widely known of the organic fibers for its strength and heat resistant characteristics. In particular, the aromatic polyamide family or aramids have a combination of high strength, toughness, and thermal stability. The more well-known aramids display high fire-resistant characteristics in that the fibers do not melt, but rather decompose at rather high temperatures of approximately 450° C., thus making the aramid fibers suitable for use in applications requiring fire-resistance. The aramid fibers are a polymer chain in which the benzene ring is oriented to allow the formation of rod-like molecular structures. As a liquid crystal and polymer solution passes through an orifice, the randomly oriented polymer chains become fully oriented and emerge from the process with near perfect molecular orientation, thereby achieving a very strong fiber. One form of such an aramid fiber is marketed under the name KEVLAR®. Another fire-resistant aramid fiber is marketed under the name NOMEX®, and yet another of the fire-resistant polyamide fibers is a fiber marketed under the name of P84®.

Acrylic fibers are well-known in the synthetic fiber and fabric industries, as are modified acrylic fibers (modacrylic), modified to exhibit heat resistance, although the extent of the heat resistance is somewhat less than the aforementioned melamines and aramids. Such modacrylic fibers exhibit higher melting temperatures, e.g., 100–125° C. or higher as compared to 90–100° C. for acrylics not so modified, and higher deflection temperatures under load, e.g., 190–221° F. at 264 p.s.i. as compared to 160–190° F. for acrylics not so modified. However, these fibers are relatively inexpensive, and in combination with other of the above fibers improve the affordability in the manufacturing of a fire-resistant fabric which is compatible with contact to the human skin.

While any one of the above fibers in and of itself is a potential candidate to create a fire-resistant fabric for use as a blanket according to the preferred embodiment, a blend of fibers from the above group will contribute desirable characteristics and enhance the affordability while maintaining its fire-resistant performance when combined into a woven fabric. It will be understood and appreciated by those skilled in the art that a variety of blends of fibers may exhibit equal fire-resistant properties and affordability while maintaining a soft pliable nature which is compatible with contact with the human skin.

In a more preferred embodiment, a fire-resistant blanket according to the present invention comprises a woven piece of fabric which, in turn, is comprised of a blend of fire-resistant fibers in approximately equal proportions of melamine/formaldehyde fiber, aramid fiber, and modacrylic fiber. Each of the fibers comprising the blanket contributes to the functionality of the woven cloth for use as a fire blanket. The melamine/formaldehyde fibers, in addition to their high degree of fire-resistance, contribute to the pliability, softness, and general compatibility with contacting human skin. The aramid fibers also contribute a high fire-resistance as well as high strength and toughness. However, the very attribute of strength and toughness limits in a practical sense the content of the aramid fiber to an upper limit of 30 to 35%, since a higher aramid fiber content causes excessive wear on the weaving machinery and the cutters for separating the woven cloth into desired dimensional pieces. The modacrylic fiber because of its low cost adds affordability to the finished fabric in addition to its pliability and compatibility to be in contact with human skin.

In use, and referring now to FIG. 1, a room in a burning structure is shown generally at 10 wherein portions of the window and furnishings are burning and posing potential barriers for the escape of an individual 12 trapped in room 10. Typically, a kit of blankets comprising a blanket 20 (discussed more fully below) and a runner 22 are stored in room 10 for emergency use. Because they are relatively soft, they can also be used on a bed, or as a lap robe, and thus serve "everyday" as well as "emergency" duty. Additionally, as a result of their pliability and toughness, the blankets withstand repeated cleanings well. Upon discovery of a fire within room 10, an individual 12, in order to provide an avenue of escape, can take a runner 22 comprised of the aforementioned blend of fire-resistance fibers and place the runner along the floor. Runner 22 is typically rectilinear in shape and has a length dimension which is substantially greater than its width dimension. The runner 22 can be placed over a burning portion of floor 18 which may be of wood or carpet construction. As a result of the fire-resistance and thermal insulating properties of runner 22, the hazards to individual 12 of transversing across burning floor 18 are greatly diminished and provide a reasonable avenue of escape for individual 12.

Typically, the most expedient avenue of escape for individual 12 from a burning room 10 may be through a window such as window 14. The windows found in most residential structures have frames which are constructed of either wood, metal, or vinyl, or a combination of the above materials. These materials are either inherently flammable or highly heat conductive thereby presenting a danger to individual 12 of incurring significant burns while egressing through window 14. One of the functions of runner 22 is for placement over the sill of window 14 thereby providing thermal insulation from either flames 16 from the burning window frame or a super heated metal frame of window 14. Runner 22 also provides the added protection of shielding individual 12 from jagged broken glass in the event window 14 was unable to be opened and required breaking of the glass panes to facilitate egress from the burning room.

Figure 2:
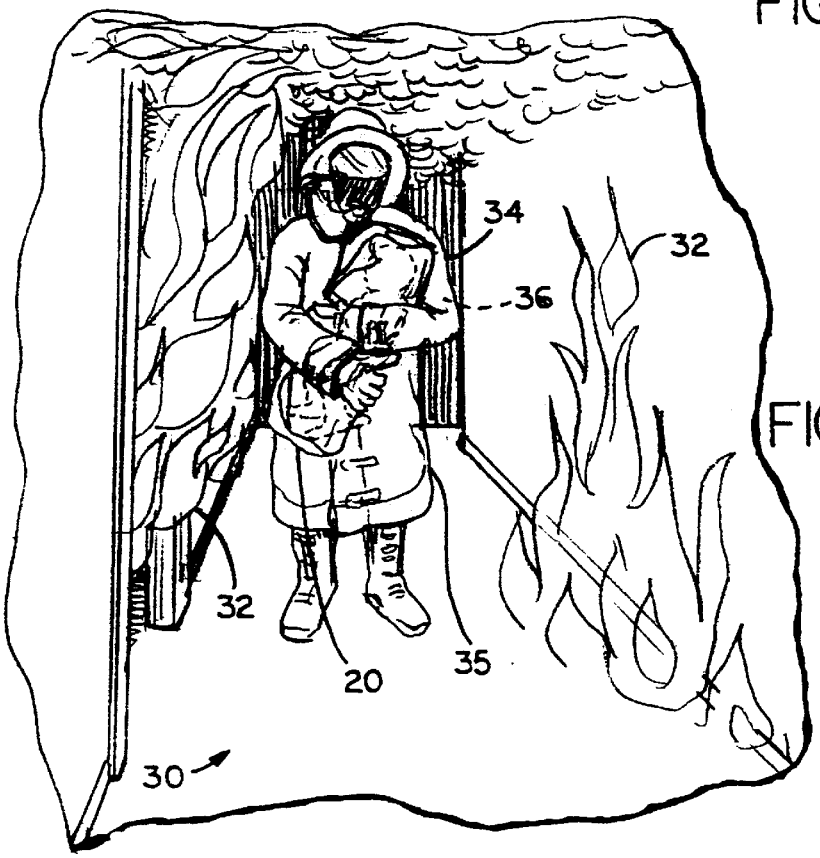
FIG. 2 shows a hallway of a burning structure and a fire fighter carrying a child to safety wherein the child is wrapped in a blanket according to the present invention.

FIG. 2 illustrates generally at 30 a portion of a burning structure showing a fire fighter 34 in typical fire fighting turn-out gear 35. A fire fighter's turn-out gear 35 provides the fire fighter with significant protection against heat and flames so that the fire fighter may indeed come into close encounter with heat and flames and not suffer bodily injury. However, individuals who require rescue from a burning structure by fire fighter 34 do not enjoy the safety of such fire protective clothing and are quite often in a minimally clothed state, or clothed with highly flammable clothing. Individuals so dressed during a rescue are exposed to high heat and flames 32 which may provide injury to the individual or have injury incurred as a result of burning or melting clothing. In FIG. 2 a fire fighter 34 is shown in typical protective clothing 35 in the process of rescuing an infant child 36 by wrapping child 36 in blanket 20 according to the present invention. Blanket 20 is typically larger than runner 22 and generally approaches a square or near square plan-form which is of sufficient dimension in which an adult person can be wrapped in cocoon-like fashion for rescue. Blanket 20 provides the requisite fire-resistance shielding between child 36 and flames 32 to thermally shield the child 36 from flames 32 with a fabric that is compatible to contact human skin. In this application, blanket 20 is usable by fire rescue personnel to extract victims from a burning structure without the victim incurring significant additional injury from heat and flames during the extraction process.

Figure 3:
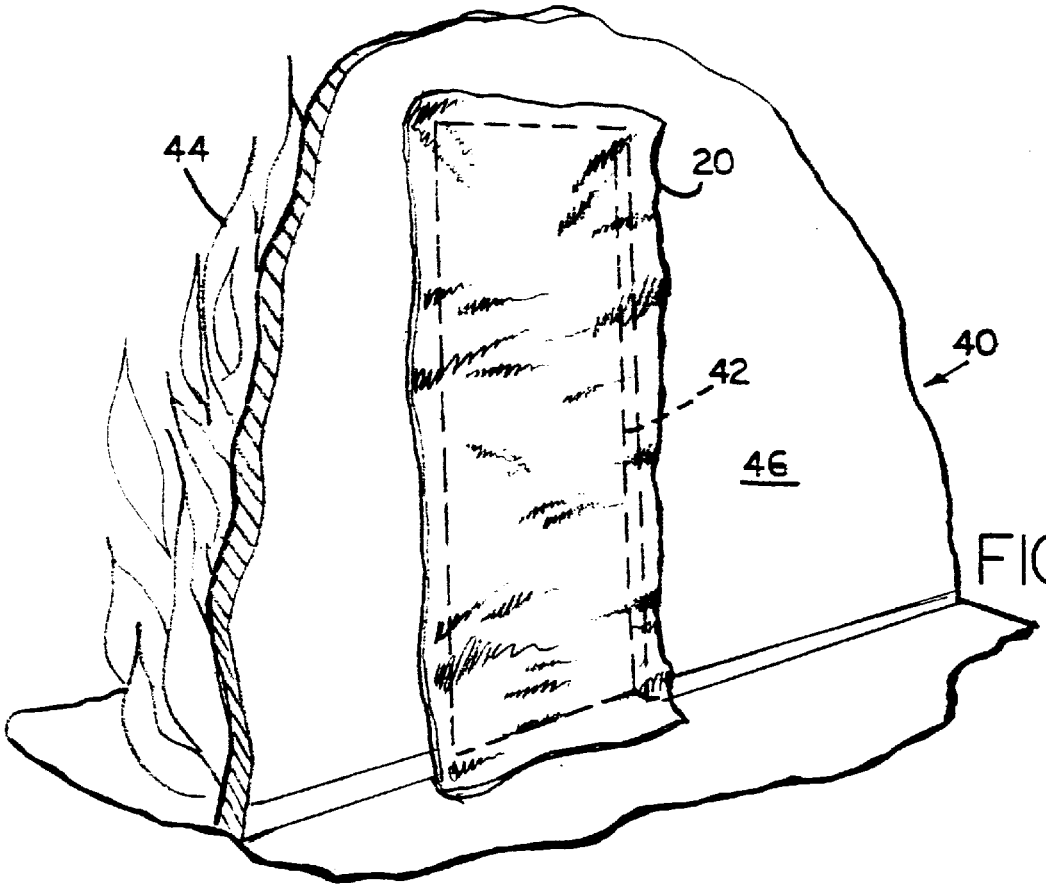
FIG. 3 is a perspective view of a room in a burning structure wherein a blanket according to the present invention is placed over the doorway to shield the occupants from burn-through of the door.

FIG. 3 illustrates a room 40 wherein fire and flames are close to a doorway 42. Blanket 20 is placed over doorway 42 to shield room 40 from flames 44. Since the doors and doorways of typical structures are often constructed of wood or other flammable materials, one danger to an individual trapped in room 40 as a result of the fire 44 burning on an opposite side of door 42 is that the fire will typically penetrate the doorway 42 prior to penetration of the surrounding wall 46. Penetration of the fire through door 42 poses a significant hazard to the individual within room 40 while awaiting rescue. The placement of blanket 20 with its fire-resistant properties across doorway 42 provides additional protection to the individual from flame and smoke intrusion into room 40, thereby providing additional critical minutes in which the individual may be rescued before becoming confronted with toxic smoke and flames.

Figure 4:
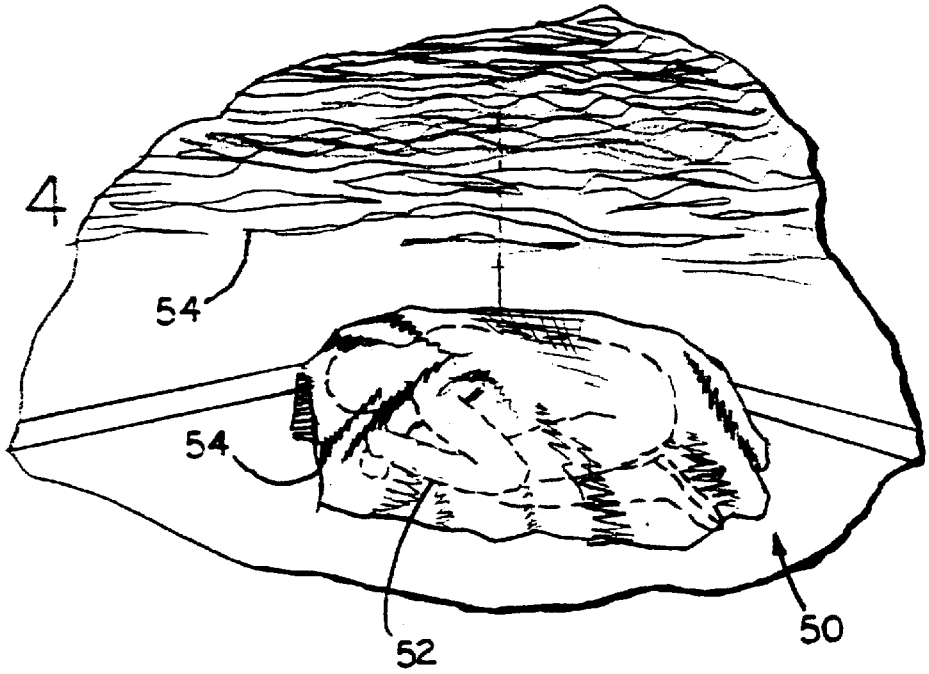
FIG. 4 is a view of a partially smoke-filled room wherein an individual is wrapped in a blanket according to the present invention to be shielded from smoke and heat until the arrival of rescue personnel.

FIG. 4 illustrates yet another manner in which blanket 20 may be used by an individual 52. While individual 52 is awaiting rescue in room 50 of a burning structure, the individual is often unable to find an area in which the individual may isolate himself or herself from flame and smoke. In such instances, individual 52 may assume a prone or crouched position upon the floor which is typically recommended as the preferred position to maximize the length of time in which breathable air is available. However, as further protection against smoke 54 and flames, individual 52 can wrap himself/herself in blanket 20 in a cocoon-like fashion wherein blanket 20 will provide heat and flame protection as well as a certain degree of air filtration.

In the foregoing description, it will be readily appreciated by those skilled in the art that modifications may be made to the invention without departing from the concepts disclosed herein. Such modifications are to be considered as included in the foregoing description.

The invention claimed is:

1. A heat insulating blanket for use in fire emergencies, said blanket comprising:

A lightweight, pliant section of fabric comprised primarily of fire-resistant organic fibers and other organic fibers having a melting temperature between 100° C.–125° C. and said fibers compatible with human skin contact, said fabric having fire-resistant properties wherein said blanket insulates a user from high heat or flame sources associated with fire emergencies and prevents burn injuries to the user until the user escapes from the fire emergency area.

2. The heat insulating blanket according to claim 1 wherein said blanket is substantially longer than wide for placing on a hot or burning surface thereby providing the user thermal protection therefrom while traversing the hot or burning surface.

3. The heat insulating blanket according to claim 2 wherein said fire-resistant organic fibers at least partially comprise melamine fire-resistant organic fibers.

4. The heat insulating blanket according to claim 3 wherein said fire-resistant organic fibers at least partially comprise a blend of melamine and aramid fire-resistant organic fibers.

5. The heat insulating blanket according to claim 4 wherein said fire-resistant organic fibers comprise at least twenty-five percent melamine fire-resistant organic fibers and at least twenty-five percent aramid fire-resistant organic fibers.

6. The heat insulating blanket according to claim 1 wherein said blanket is of generally equal length and width sufficient to wrap a human being in cocoon-like style to thermally insulate the human from the surrounding heat and flames of the fire emergency.

7. The heat insulating blanket according to claim 6 wherein said fire-resistant organic fibers at least partially comprise melamine fire-resistant organic fibers.

8. The heat insulating blanket according to claim 7 wherein said fire-resistant organic fibers at least partially comprise a blend of melamine and aramid fire-resistant organic fibers.

9. The heat insulating blanket according to claim 8 wherein said fire-resistant organic fibers comprise at least twenty-five percent melamine fire-resistant organic fibers and at least twenty-five percent aramid fire-resistant organic fibers.

10. A method for providing for fire safety, said method comprising the steps of:

providing a user with a lightweight, pliant blanket made of fire-resistant organic fibers and other organic fibers having a melting temperature between 100° C.–125° C. and said fibers compatible with human skin contact which can serve to provide warmth during normal usage; and wrapping the user in the blanket in the event of fire to provide protection from the fire and facilitate the user's escape from the fire.

11. The method according to claim 10 including, after the wrapping step, the step of:

removing the user wrapped in the blanket from the fire area.

12. The method according to claim 11 including, after the blanket providing step, the step of:

providing the user with another lightweight, pliant blanket made of fire-resistant organic fibers wherein the blanket is substantially longer than wide.

13. The method according to claim 12 including, after the step of providing another blanket, the step of:

spreading the long, narrow blanket across a hot or burning surface.

14. The method according to claim 13 wherein the removing step includes removing the user by traversing the spread out long, narrow blanket.

15. The method according to claim 14 wherein the fire-resistant organic fibers are partially melamine fire-resistant organic fibers and partially aramid fire-resistant organic fibers.

16. The method according to claim 15 wherein the fire-resistant organic fibers are at least twenty-five percent melamine fibers and at least twenty-five percent aramid fibers.

17. A method for providing for fire safety, said method comprising the steps of:

providing a user with a lightweight, pliant blanket made of fire-resistant organic fibers and other organic fibers having a melting temperature between 100° C. and 125° C. and said fibers compatible with human skin contact which can serve to provide warmth during normal usage;

spreading the blanket across a hot or burning surface; and removing the user from the fire or hot area by traversing the spread out blanket.

* * * * *